United States Patent [19]

Hubbard, Jr.

[11] Patent Number: 4,801,464

[45] Date of Patent: Jan. 31, 1989

[54] SINGLE SERVING BREWING PACKET AND METHOD OF MAKING SAME

[76] Inventor: Maury A. Hubbard, Jr., 700 Linden Tower Centre, Richmond, Va. 23219

[21] Appl. No.: 165,358

[22] Filed: Feb. 29, 1988

Related U.S. Application Data

[63] Continuation of Ser. No. 875,282, Jun. 17, 1986, abandoned, and a continuation-in-part of Ser. No. 752,357, Jul. 5, 1985, abandoned.

[51] Int. Cl.[4] ..... B65B 29/02

[52] U.S. Cl. ..... 426/79; 426/77; 426/83; 426/84; 206/0.5

[58] Field of Search ..... 426/77-84; 206/0.5

*Primary Examiner*—Steven Weinstein

*Attorney, Agent, or Firm*—John F. C. Glenn

[57] ABSTRACT

Roast ground coffee or the like is layered and confined between water permeable walls while brewing in a cup or mug from which it is to be consumed. The walls with coffee layered between may be wound, folded or stacked to form the desired packet. The walls include a filter material and may also include a reticulated heat sealable sheet next to the coffee. Separators between coffee confining walls promote water circulation and speed brewing.

18 Claims, 6 Drawing Sheets

SINGLE SERVING BREWING PACKET AND METHOD OF MAKING SAME

This application is a continuation of application Ser. No. 06/875,282 filed 6/17/86, now abandoned, and continuation-in-part of application Ser. No. 752,357 filed 7/5/85 now abandoned.

BACKGROUND OF THE INVENTION

Coffee and tea have long been brewed into beverages outside of the cups or mugs from which they are drunk. Brewing these beverages outside of a cup or a mug involves procedures and equipment with which the present invention is not concerned.

When brewing within a single cup or the like, there are two well established procedures, both beginning with filling the cup with water preheated close to the boiling point. One procedure is to drop into the water a bag containing the desired amount of prepared tea leaves or ground roasted coffee beans. Conventional tea bags are porous enough to let the water pass in and out during brewing, but are restrictive enough to hold back the solid contents. This works quickly and well for tea leaves, but not as well for ground coffee beans, which tend to form a self-plugging, soggy mass in a bag. Also, tea bags have a long shelf life, whereas coffee ready for brewing has to be specially packed and sealed to prevent spoilage. The alternative procedure is to extract and crystalize the soluble content of the tea or coffee, so that the resultant dry powder can be easily measured and dropped into a cup of hot water, where it readily dissolves. This alternative is convenient and popular, but some degree of aroma and flavor is lost in the process.

These considerations suggest that tea in tea bags would remain more popular than powdered tea, and that seems to be the case. Powdered coffee, on the other hand, is in large scale use for making one serving of coffee at a time, while coffee in bags like tea bags is little used, although offered on the market. Accordingly, there has been a long felt and unsatisfied need for improved packaging for purposes of combining the benefits of the full aroma and flavor of roast and ground coffee beans with the convenience of individual immersible packets for single serving use.

Prior art reviewed in this connection included particularly U.S. Pat. Nos. 1,075,210 (Heyl et al.), 2,716,607 (Waline) and 4,465,697 (Brice et al.), and also 1,555,515 (Peal), 1,759,166 (Medin), 2,192,605 (Salfisberg), 2,328,018 (Irmscher), 3,352,226 (Nelsen), 3,387,978 (Major), 3,542,561 (Rambold), 3,607,302 (Beck), 3,833,740 (Schmidt) and 4,141,997 (Syroka et al.), and the patents cited in the parent application Ser. No. 06/752,357 filed July 5, 1985.

SUMMARY OF THE INVENTION

In accordance with the present invention, an immersible packet for brewing coffee is provided by confining a thin layer of freshly roasted and ground coffee beans between water permeable retaining walls, the coffee being substantially evenly spread between and in contact with wall areas totalling about 15 to 50 square centimeters for each gram of coffee (preferably at least 25 square cm per gram, and for best results about 30 to 45 square cm per gram, especially in terms of achieving full strength in minimum brewing time). For most single serving cups or mugs each packet preferably has about 6 to 12 grams of ground coffee in contact with a total wall area of about 180 to 540 square cm. This permits substantially total immersion of the packet in about $\frac{1}{8}$ to $\frac{1}{3}$ liter (about 4 to 12 fluid ounces) of water in a conventional single serving cup or mug. The retaining walls can extend in various forms, such as radially, concentrically, zig zag or parallel, but in the present preferred embodiment are wound in a spiral. In any case, the packet is secured together to hold the coffee in place between the porous walls during brewing. Where the porous walls extend next to each other with no coffee between, it is advantageous to interpose therebetween a separator to permit flow along the separator and thence to and from the porous walls. Such a separator may, for example, be a reticulated sheet or fabric, or a superimposed pluralty thereof.

A handle, such as a stiff extension or a string extending in a loop from opposite sides of one end of the packet, is preferably used for lifting it out of the cup when brewing is complete. The handle also facilitates hastening the brewing process by lifting the packet up and letting it fall back while immersed and preferably while oriented with its spiral axis extending in the vertical direction of movement.

Freshly roasted and drip ground coffee is preferably used in each packet, which is promptly wrapped individually in inert gas or under vacuum and sealed to protect the contents against deterioration by excluding air and moisture.

The invention is also applicable to particulate brewable food and beverage products other than coffee; for example, roasted and ground chicory.

Other details, objects and advantages of the invention will become apparent as the following detailed disclosure proceeds.

BRIEF DESCRIPTION OF THE DRAWINGS

Present preferred embodiments of the invention are shown, diagramatically and for purposes of illustration only, in the accompanying drawings, in which:

FIG. 44 shows an exploded semi-isometric view of a stack of a pair of the units shown in FIG. 43 with a pair of separators in between;

FIG. 46 shows an exploded semi-isometric view of a stack of a pair of circular disc-like units in which a layer of coffee is sealed, with a pair of separators in between.

DETAILED DESCRIPTION OF PRESENT PREFERRED EMBODIMENTS

Figure 1:
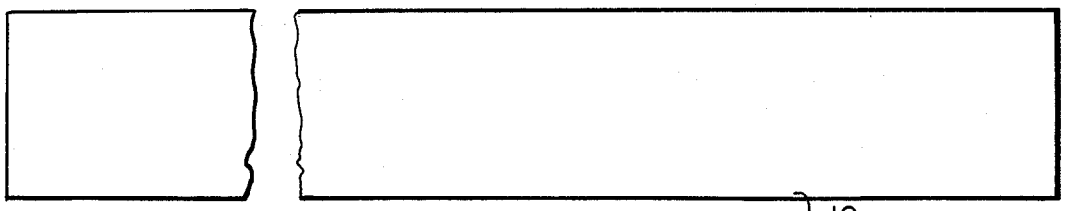
FIG. 1 shows a plan view, partially broken away, of a sheet of porous material for supporting a layer of ground coffee.

Referring now more particularly to the drawings, a rectangular sheet 10 is laid out in a generally horizontal position, and freshly roasted ground beans of coffee 12 are spread thinly and evenly over the upper face of the sheet, except adjacent to its marginal edges. A second rectangular sheet 14 is placed over the coffee 12 and sheet 10, and the two sheets are secured together along the boundaries of the layer of coffee 12 by connections 16. The illustrated connections are stitching, but other connections can be used, such as staples, crimping, water insoluble adhesive, or heat sealing material. The connections 16 complete an envelope 17 which restrains escape of coffee 12 from between sheets 10 and 14 outwardly toward their marginal edges. The connections 16 also hold the sheets together so as to urge their opposed faces against the layer of coffee 12, thereby tending to hold the coffee in place against shifting between the sheets during brewing. Experience shows that connections 16 along the periphery as illustrated are enough for the purpose but additional stitching or the like may be run at intervals from one side to the other of the length of the assembly, as a precaution.

Figure 23:
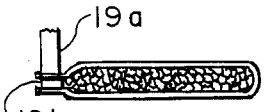
FIG. 23 shows an end view corresponding to FIG. 22, but showing the sheet of FIG. 22 after it has been wrapped around the layer of coffee to form a side fin, and showing a heat sealing tool acting on a heat sealing strip in the fin to seal the overlap.
Figure 24:
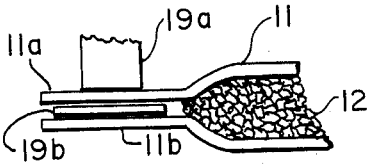
FIG. 24 shows an enlarged view, partially broken away, of the fin and heat sealing tool and strip of FIG. 23.
Figure 25:
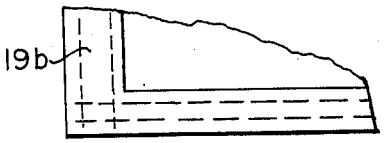
FIG. 25 shows a plan view, partially broken away, of one end of the envelope being sealed in FIG. 23.
Figure 26:
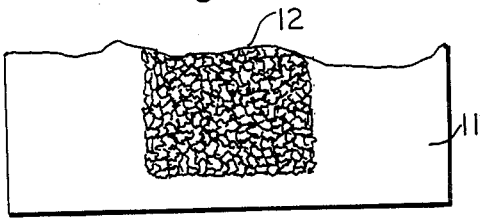
FIG. 26 shows a plan view corresponding to FIG. 21, but with the coffee layer centered between the side edges of the porous sheet.
Figure 27:
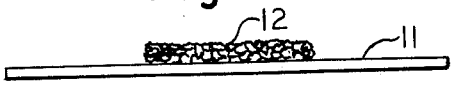
FIG. 27 shows an end view of what is shown in FIG. 26.
Figure 28:
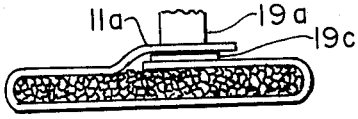
FIG. 28 shows and end view corresponding to FIG. 27, but showing the sheet of FIG. 27 after it has been wrapped around the layer of coffee to overlap over the middle of the layer, and showing a heat sealing tool acting on a heat sealing strip to seal the overlap.
Figure 29:
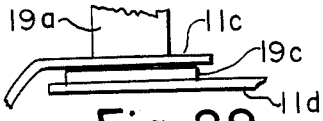
FIG. 29 shows an enlarged view, partially broken away, of the overlap and heat sealing tool and strip of FIG. 28.
Figure 30:
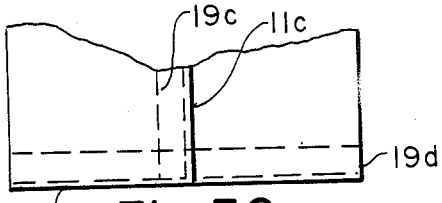
FIG. 30 shows a plan view, partially broken away, of one end of the envelope being sealed in FIG. 28.
Figure 31:
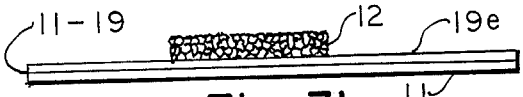
FIG. 31 shows an end view corresponding to FIG. 27 except for a sheet of heat sealing material extending across the area of the porous sheet and between the coffee layer and porous sheet.
Figure 32:
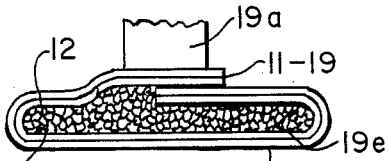
FIG. 32 shows an end view corresponding to FIG. 31 but showing the porous and heat sealing sheets after they have been wrapped around the coffee to overlap in the manner shown in FIG. 28, and showing a heat sealing tool acting on the heat sealing sheet to seal the overlap.
Figure 33:
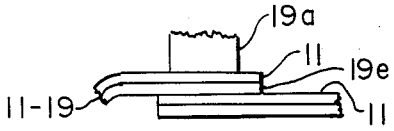
FIG. 33 shows an enlarged view, partially broken away, for the heat sealing tool and overlap of FIG. 32.

For purposes of manufacture of such an envelope, it may be desirable to replace the sheets 10 and 14 with a double width lower sheet 11 (FIGS. 21, 22, 26, and 27) folded over coffee layer 12 along one or both sides until its margins overlap in a fin along one side (FIGS. 23–25) or in an overlap along the middle (FIGS. 28, 29) . The overlapping margins form a tube [for this approach, see U.S. Pat. Nos. 2,255,957 (Yates), 2,362,460 (Barnett) and 3,053,665 (Irmscher)], and are preferably heat sealed together by a tool 19*a* heating through the filter paper to activate heat sealing material between the overlapped margins. The ends of the tube are similarly sealed. The heat sealing material may be in the form of strips or stripes placed where sealing is needed; for example, see strip 19*b* between overlapped margins 11*a* and -*b* of the side fin folded form of sheet 11 shown in FIGS. 23–25; strip 19*c* between margins 11*c* and -*d* of the center overlap folded form of sheet 11 shown in, FIGS. 28–30; and strip 19*d* between the overlapped margins at opposite ends of the tubular folded form of sheet 11 shown in FIG. 30. A preferable alternative is to provide the heat sealing material in the form of a sheet substantially coextensive with sheet 11 and made of a porous heat sealable reticulated fabric 19*e* hereinafter described (FIGS. 31–33). In any of these cases, the layer of coffee is fed onto the sheet at a controlled rate while the sheet advances before completion of folding, but coffee is eliminated inwardly of where the tube is to be cut to form the ends of an elongated envelope from which a packet is to be formed. Heat sealing across the cut ends of the tube holds in the shortened ends of the coffee layer.

Figure 5:
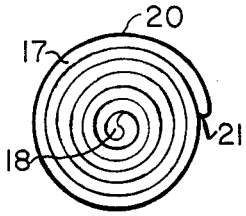
FIG. 5 shows an edgewise top view, in reduced scale, of the spiral resulting from rolling up the structure shown in FIG. 4 around one of its ends, as seen parallel to the axis of the spiral.
Figure 6:
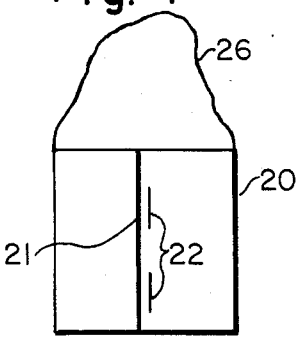
FIG. 6 shows a side view of what is shown in FIG. 5, with a handle added at the upper end.
Figure 48:
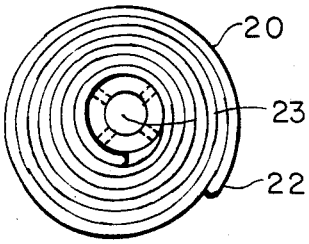
FIG. 48 shows a view corresponding to FIG. 5 but showing the spiraled structure wound around a radially perforated hollow cylindrical core.

After securing together the cut ends and the overlapped margins of the resultant tube enclosing the coffee, the resulting elongated envelope 17 is preferably rolled up in a spiral, to produce a compact packet 20 (FIGS. 5 and 6). One end 18 of the envelope is at the center of the spiral and the other end 21 of the envelope is secured by a staple 22 or other connection, such as a heat seal, to an adjacent wall of the spiral. The spiral preferably has no axial advance in either direction, in order to minimize the space occupied by the packet and for convenience of manufacturing. However, the option is available to use axial advance of the spiral to produce one concave conical end and one convex conical end, thereby increasing the surface area of the packet exposed directly to the water during brewing. Also, a hollow center is another option for spiral and other packets in accordance with the invention, provided that it does not result in significant impairment of the confining action of the walls against the layered coffee. For example, a mandrel of 6 mm was used to spirally wind identical test packets (using 12 grams of "Maxwell House" roast drip-grind coffee in an envelope 22 inches long and 1 ½ inches wide in the form of the envelope 17′ hereinafter described), one in which an opening was left as it was when the mandrel was removed, one in which the mandrel hole was plugged with solid metal and one in which the mandrel hole was reinforced by a 6 mm outer diameter perforated plastic tube. After two minutes brewing time in 8 ounces of initially boiling water, with agitation every second, the brew from the samples was observed, and then the brew was filtered and the residue on the filter was observed. No significant difference in results was observed in the results of the samples, or between their results and those of a comparable sample wound spirally with substantially no hollow along the spiral axis. Even so, a hollow in the packet adds to its bulk, but may result from practical considerations, such as the need for withdrawing a mandrel on which a spiral packet has been wound (e.g. see packet 20′ spirally wrapped around radially perforated hollow cylindrical core 23 shown in FIG. 48).

The sheets 10 and 14 need not consist of identical materials. In any case, the double width single sheet 11 is preferred, and the present preferred material of any of these sheets comprises filter paper coarse enough to facilitate movement of water into, through and out of the packet 20, while fine enough to hold back at least most of the particulates in the coffee, e.g., filter paper such as that used in filtering conventional drip ground coffee. The filter paper may be of natural or other fibers, such as regenerated cellulose [see U.S. Pat. No. 2,531,594 (Abrahams)]. Other materials for these sheets can be used, such as flexible metal or plastic screens or the like, if the foraminous characteristics are such as to achieve the water passage and filtering purposes just described, or if such other materials are laminated to suitable filter material. For example, see subsequent details on bonded fabric 19*e*. A coarse textured sheet of filter paper or a reticulated sheet between the filter paper and coffee helps to hold the coffee layer in place between the sheets. The sheet may also be fluted (bent back and forth parallel to the ends) for that purpose, and also to increase surface area exposed to water and to make spaces between the spiral layers to facilitate circulation of water through the package.

Figure 7:
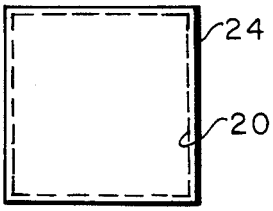
FIG. 7 shows a side view of the packet shown in FIGS. 5 and 6, with an overwrap.

After the packet has been formed, it can be used immediately to brew coffee. However, it is normally enclosed and sealed promptly, in a tight overwrap 24 (FIG. 7). Air and moisture are excluded from the overwrapped packet by use of vacuum or inert gas during the overwrapping and sealing operation. The overwrap may be of an suitable material, such as organic film or coated aluminum foil or foil laminated to film. The preferred overwrap material is a laminate of aluminum foil with an organic film or coating of polymers or co-polymers of polyethylene, vinyl chloride, vinylidene chloride, polyester or other such organic polymers used in flexible packaging.

Figure 8:
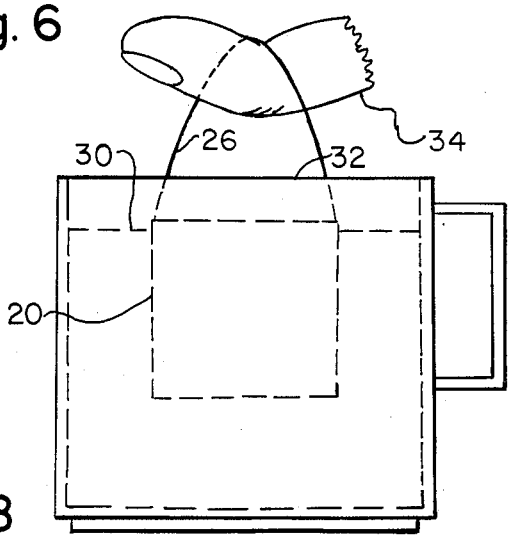
FIG. 8 shows the unwrapped packet of FIGS. 5 and 6 supported by a finger while the packet is immersed in a cup of hot water.
Figure 9:
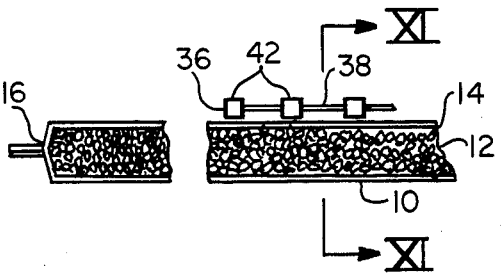
FIG. 9 shows what is shown on the left in FIG. 3, further broken away and with end stitching and an added spacer element laid across the top of the second sheet of porous material.
Figure 10:
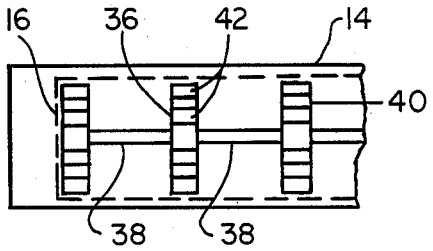
FIG. 10 shows a top view of what is shown in FIG. 9.
Figure 18:
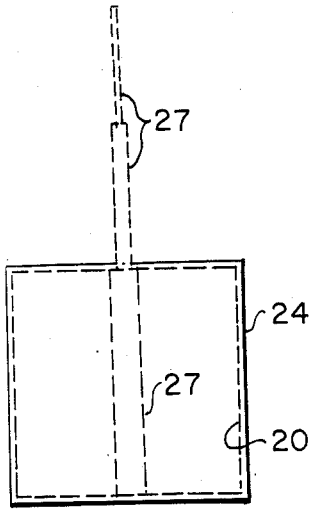
FIG. 18 corresponds to FIG. 7 but enlarged and showing a telescoped rigid handle within the overwrapped package.
Figure 19:
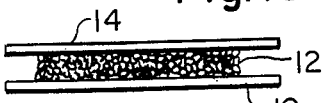
FIG. 19 shows an end view of what is shown in FIG. 3.
Figure 20:
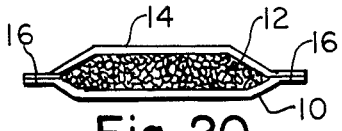
FIG. 20 shows a transverse section on the line XX—XX in FIG. 4.
Figure 21:
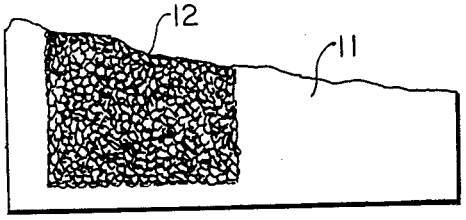
FIG. 21 Shows a plan view partially broken away, of one end of a layer of ground coffee on one side of a longer length of porous sheet.
Figure 22:
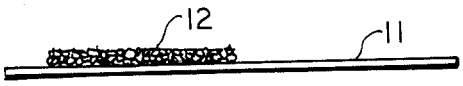
FIG. 22 shows an end view of what is shown in FIG. 21.

Before overwrapping, the packet is preferably provided with a handle 26 (FIGS. 6 and 8), such as a length of string attached to opposite side edges of packet 20, as shown in FIG. 6. A stick-like rigid handle may be substituted for string 26, in which case the spiral may be wound around the stick 27 to anchor it and hold it out along the spiral axis, and the stick may telescope flush with the end of the packet while overwrapped, and extend from the packet (as shown in phantom lines at 27') after removal of the overwrap (FIG. 18). Also, packet 20, which is initially of generally cylindrical shape, may be squeezed against its sides before being overwrapped so that the overwrapped packet will be more nearly cubical or rectangular in shape, and hence a plurality of the overwrapped packets will occupy minimum space in a larger rectangular container suitable for retail sales purposes.

After removal of overwrap 24, the packet may be placed in water 30 in a cup 32. The water may be preheated or the cup of water with the packet in it may conveniently be heated in a microwave oven. The packet sinks rapidly as the water seeps between the spiral turns and through sheets 10 and 14 until it reaches coffee 12. When completely saturated the packet floats with only a slight portion above the water. The handle 26 is preferably held, at least initially, by a finger 34 to support the packet in the water with its spiral axis extending vertically. This facilitates jiggling the packet up and down to accelerate the brewing action, although such orientation and agitation are not essential for brewing action. After a desired degree of brewing has taken place, judging by the color of the brewed coffee, fingers 34 may lift handle 26 to remove packet 20 from the cup. The freshly brewed and still hot and aromatic coffee in the cup is then ready to be consumed, with all the good qualities of taste and aroma which have been associated in the past with coffee produced by conventional drip methods.

The amount of ground roast coffee used for each packet is as stated in the above Summary of Invention. Tests have been made with ten grams of "Maxwell House" roasted and drip ground coffee spread on a filter sheet measuring 36 by 1¼ inches (cut and pieced together from filter papers for drip coffee), covered with a like sheet, stitched all around about ⅛ inch from the edge, rolled up in a spiral, stapled at the end, and provided with a string handle. This has proved satisfactory for brewing coffee in a normal cup holding about 8 ounces of water preheated to the boiling point, within a period of about two minutes after initially placing the packet in the water. When the same amount of coffee is put in a bag and immersed in water, it takes longer to produce substantially the same strength of brewed coffee in the cup. Like results were obtained when the filter sheets instead measured 22 by 1½ inches, producing a spiral packet having a circumference of about five inches. Other tests were made using six grams of "Expresso" coffee similarly packaged with about the latter size of filter paper with a like area to weight ratio and immersed with occasional agitation for about two minutes in preheated water, which also resulted in producing a comparable strength of brewed coffee in about 6 ounces of hot water. The said ratio refers to area of paper in contact with the coffee relative to the weight of the coffee. This is significant because more paper area relative to the amount of coffee means more water can reach and return from the coffee in a given length of time, thus shortening brewing time and more effectively filtering the brew.

Figure 11:
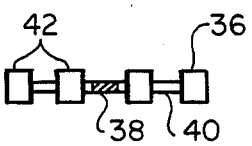
FIG. 11 shows an enlarged section on the line XI—XI in FIG. 9, omitting all but the spacer element.
Figure 12:
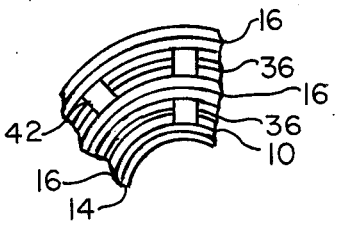
FIG. 12 shows a broken away end view of some of the layers of a spiral wound from the assembly shown in FIGS. 9 and 10.

Increased circulation between the successive windings of the spiral packet may be obtained by adding a reticulated separating element 36 to the envelope before winding them up in a spiral (as shown in part in FIG. 12). For example, the element 36 may be in the form of a ladder-like plastic casting having a lengthwise spine 38, a series of spaced cross-members 40 extending substantially between the lengthwise edges of the strips holding the coffee (as shown in FIG. 11), and spacer projections 42 extending from opposite sides of each cross-member 40 to engage the side walls of the strips holding the coffee (as shown in FIG. 12). The spacer may have various other forms, such as side-by-side helices with their coils spaced apart and their helical axes wound spirally between the surrounding coils of sheets 10 and 14.

Figure 14:
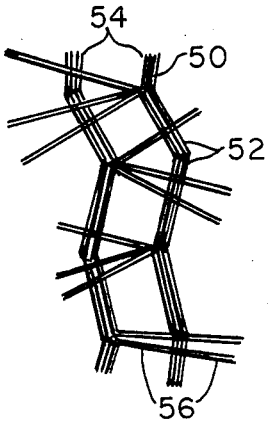
FIG. 14 shows an enlarged view, partially broken away, of the knit fabric shown in FIG. 13.
Figure 16:
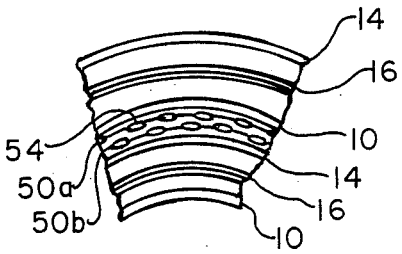
FIG. 16 corresponds to FIG. 12, but with two layers of the fabric of FIGS. 13 and 14 substituted for the spacer shown in FIGS. 10 and 11.
Figure 17A:
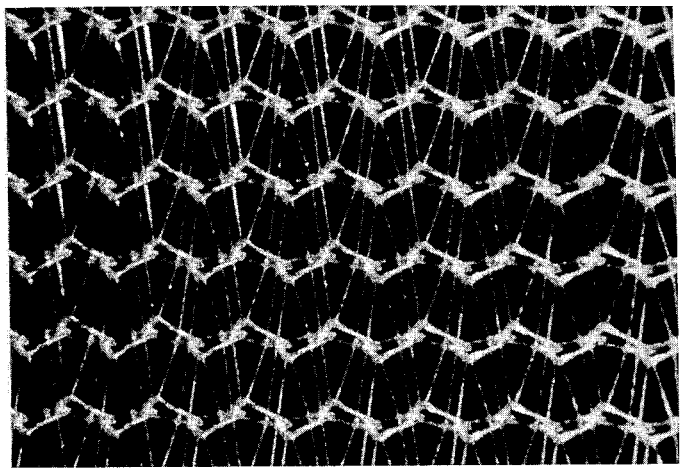
FIG. 17A shows an enlarged photograph of the fabric shown in FIG. 13.

The form of spacer thus far most successful for improved water circulation and hence fast brewing was cut to fit closely within the outline of the assembly to be spirally coiled (but a little shorter lengthwise) from an open mesh fabric 50 of intertwined polymeric strands, such as the fabric shown in FIG. 17A and supplied by Virginia Paint Co., Inc. of Richmond, Va. for filtering paint in a five gallon can. This fabric is knitted of polymeric filament 52 to form successive spaced chains of loops 54 extending generally parallel to each other and connected by cross-links 56 (FIG. 14, 15 and **17*a*). The fabric thickness is close to the thickness of filter paper conventionally used for brewing drip ground coffee. A single layer of the fabric can be placed over the assembly before rolling in a spiral, but best results are obtained when an additional layer 50*b* of the fabric is superimposed over the first layer 50*a* before winding (shown wound in FIG. 16). It is preferable to align the chains 54 to extend between and at right angles to the spiral ends of the packet, to facilitate movement of water into and out of the packet in directions generally parallel to its winding axis. Also, the combined layers of fabric 50*a* and 50*b*** are and preferably should be considerably thinner than the combined thickness of the coffee layer and surrounding filter paper. Such double layers of separator fabric add little to the bulk of the spiral packet, and water was observed to fall more freely from the packet with a pair of such thin spacing fabrics, when the packets were lifted out of cups, than was observed when using other spacers that have been tested.

Figure 13:
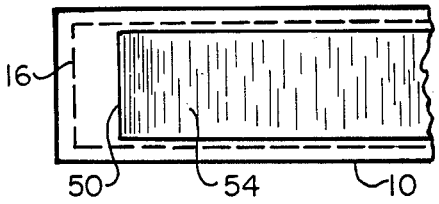
FIG. 13 shows a top view corresponding to FIG. 12, but enlarged and showing a knit fabric as the spacer element.
Figure 15:
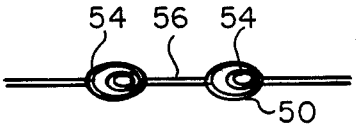
FIG. 15 shows an end view of what is shown in FIG. 14.

Tests were made to see whether the separator fabric shown in FIG. 17A could be used to replace paper for sheets 10 and 14 or 11 as well as for separation between coils of envelope 17. When this was done with a single layer of the fabric as separator, and with all layers of the fabric having their chains 54 oriented as shown in FIG. 13, the packet sank quickly but brewing did not take place quite as quickly as in the case of a packet of like dimensions embodying the above-mentioned best example. Also, there was a little more residue left at the bottom of the cup, and the packet appeared to retain more water internally when lifted out of the cup. When the fabric was used to replace the paper without any separator, and with a belt of paper around the circumference, brewing was still slower, there was more residue, and the packet was slower to sink.

A further improvement is to replace the sealing strips **19*b*, -*c* and -*d* (FIGS. 23–30) with a sheet of porous heat sealable fabric 19*e* (FIGS. 31–33) which extends against substantially the whole inside area of the filter paper in a manner which provides a heat sealable material where needed, provides porosity to permit passage of water into and out of the packet, and provides a reticulated structure which reinforces the filter paper and inhibits sidewise and lengthwise shifting of the layer of coffee resting against the fabric. Such a fabric 19e is preferably extended across and heat bonded where touching the whole area of one side of filter paper 11' (FIG. 31), to form a composite web 11–19. Observation of tests of packets of the invention made with web 11–19 show that the presence of fabric 19e bonded to substantially the whole inside area of the filter paper improves brewing action in terms of strength of brew in a given brewing time. The coffee layer is fed onto the fabric side of the web, which is then folded over and heat sealed along the margins (as shown in FIGS. 32 and 33, and across the ends in a manner similar to FIG. 30) to provide an elongated envelope 17'** around the layer of coffee. This envelope can then be rolled up or otherwise used to form a completed packet.

Figure 17B:
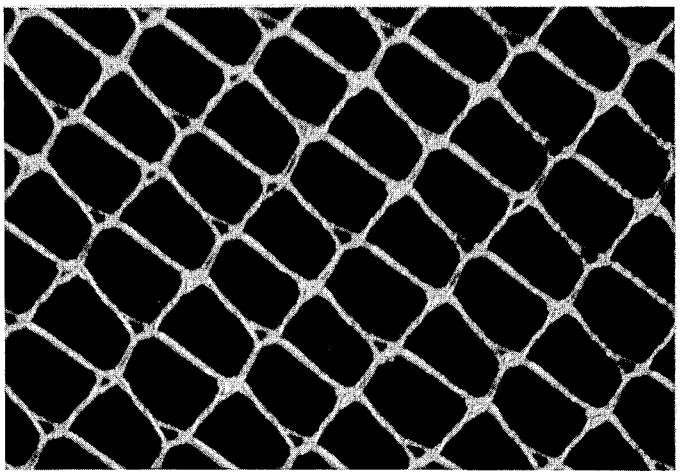
FIG. 17B shows a correspondingly enlarged photograph of a nylon tulle heat sealing fabric.
Figure 17C:
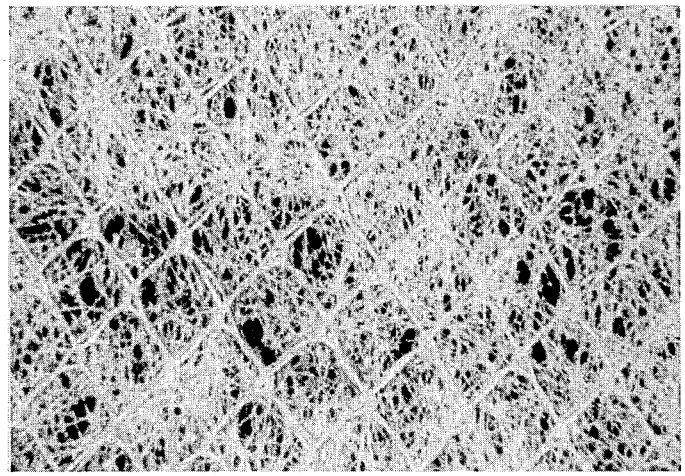
FIG. 17C shows a correspondingly enlarged photograph of a heat sealing fabric as shown in FIG. 17B bonded to filter paper shown beneath the heat sealing fabric.

The present preferred embodiment of the fabric 19e is a fine knitted or woven mesh of heat sealable polymer such as nylon or the like, such as the nylon tulle sold for use in brides' wedding veils. An enlarged photograph of such tulle is shown in FIG. 17B, and of such tulle bonded to "Melitta" wraparound filter paper is shown in FIG. 17C. Since the ground coffee tends to enter into the interstices of the reticulated fabric 19e, it tends to be held there against shifting movement. Also, this entry of the coffee into the fabric 19e, together with the thinness of the fabric, has the effect of minimizing any significant thickening of the packet as a result of the presence of the fabric 19e. Instead of preliminary knitting or weaving of the fabric, its fibers can be made part of the web by bonding them in an equivalent arrangement on the supporting filter paper.

While a spirally rolled form of packet is believed to be best for purposes of the invention, other configurations can also be used. For example, the starting assembly may be an elongated layer of coffee confined within envelope 17' of web 11–19.

Figure 34:
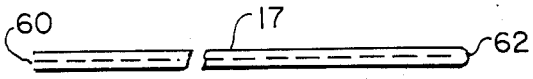
FIG. 34 shows a schematic view partially broken away, of an elongated sealed envelope around a layer of coffee (shown as one solid line) after it has been folded once about its middle over a first set of separators (shown as one dotted line)
Figure 35:
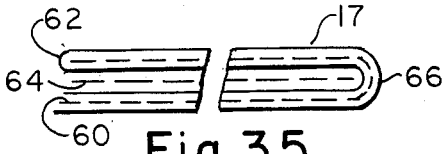
FIG. 35 shows a corresponding view, partially broken away, of the envelope and separator set of FIG. 34 after being folded a second time, about a shorter second separator set.
Figure 36:
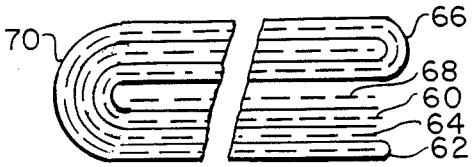
FIG. 36 shows a corresponding view, partially broken away, of the envelope and separator set of FIG. 35 after being folded a third time, about a still shorter third separator set.
Figure 37:
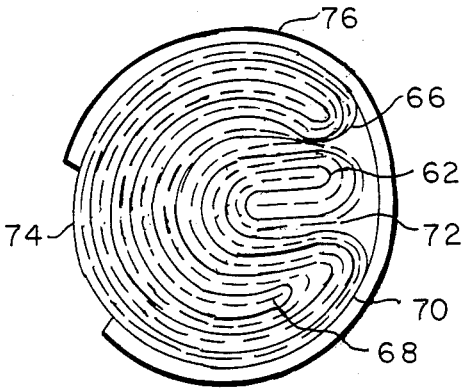
FIG. 37 shows a corresponding view, partially broken away, of the envelope and separator set of FIG. 36 after being folded a fourth time, about an even shorter separator, and also showing a retainer band (shown by a pair of closely spaced lines) around part of the outer periphery of the resultant quadra-folded unit.
Figure 38:
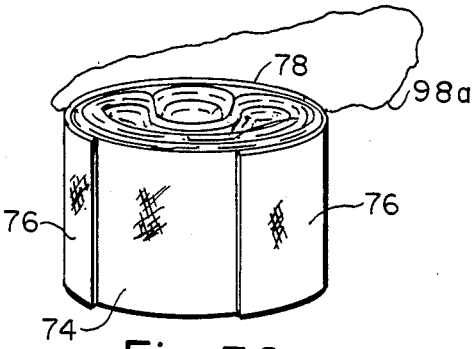
FIG. 38 shows a view from below what is shown on the left side of FIG. 37, but tilted enough to show in perspective the folded envelope edges shown in FIG. 37.
Figure 39:
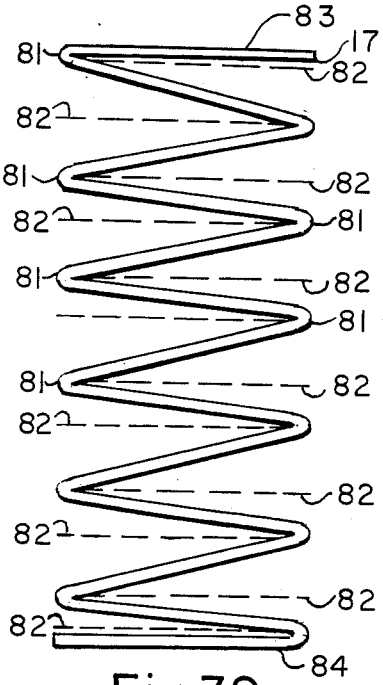
FIG. 39 shows an envelope like that shown in FIGS. 34–37, but folded in open Z-form with a set of separators (each shown by a dotted line) between each fold.

The multifolded form of packet 78 shown in FIGS. 37 and 38 is made by placing over the said envelope 17' a first set 60 of a pair of lengths of separator fabric (such as shown in FIG. 17A) to cover slightly less than half the length of the envelope, which is then folded at 62 in the middle to cover the said first set of separator sheets (see FIG. 34; in this and the related FIGS. 35–38 the envelope 17' is shown by a single solid line marked 17', and each of the designated sets of separator pairs is shown by a single dotted line marked with the designating number). A second set 64 of separator sheets of half the length of the first set is then extended over the once-folded unit against its side nearest to the bend line of the initial fold, and with the second set of separators extending from adjacent to the initial bend line to the middle of the once folded unit. The unit is then folded at 66 in the middle, to enclose a second set 64 of separator sheets. A third set 68 of separator sheets half as long as the second set is then placed against one side of the twice-folded unit, in position to be enclosed between the two halves of that side when the twice-folded unit is folded at 70 along its middle. A fourth set of separator sheets 72, half as long as the third set, are then placed against one side of the thrice-folded unit, in position to be folded at 74 between the two halves of one side of the thrice-folded unit when it is folded at 74 a fourth time along the middle of said side to enclose the fourth set 72 of separator sheets. The quadra-folded unit is then bound together around enough of its circumference to hold it together during brewing. This is preferably done by encircling most of the circumference with a wide band 76 of a web like the web 11–19, with the heat sealing fabric inside, and heat sealing the encircling band to the quadra-folded unit. Since the folds just described are similar to the fold of the letter C, this form of packet can be described generally as a C-form multifold packet.

Figure 40:
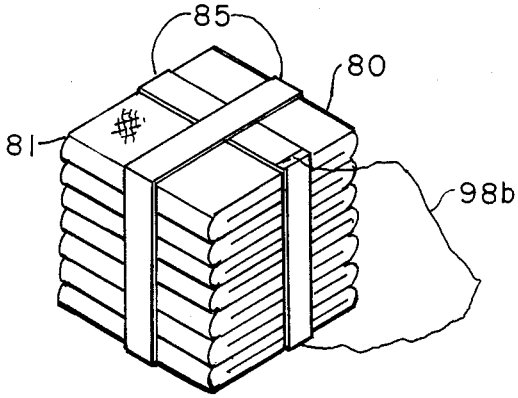
FIG. 40 shows a packet of the envelope and separators of FIG. 39 after they have been pressed together and secured by encircling bands.
Figure 41:
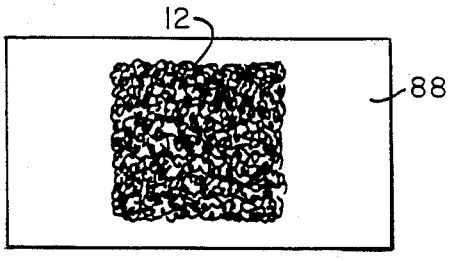
FIG. 41 shows a plan view of a square layer of coffee on a larger rectangular composite web of heat sealable fabric bonded to a porous sheet.
Figure 42:
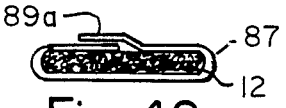
FIG. 42 shows a side view of the edges of the web and coffee layer along lower part of FIG. 41, after the longer opposite margins of the web have been folded over the coffee and heat sealed where they overlap across the middle of the coffee layer.
Figure 43:
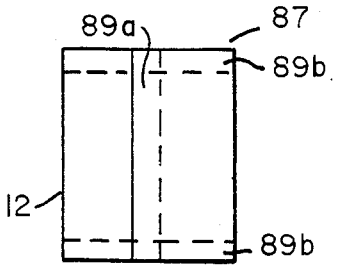
FIG. 43 shows a plan view of the unit shown in FIG. 42, after the coffee has been sealed in by heat sealing across each of the other two opposite margins where it overlaps itself as a result of folds shown in FIG. 42.
Figure 44:
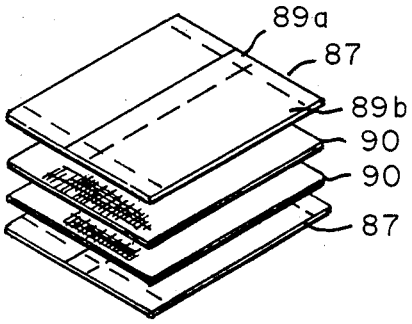

The multifolded form of packet 80 shown in FIG. 40 is made by folding envelope 17' back and forth in successive reverse bends 81 like the letter Z, and by inserting a pair 82 of short lengths of separator fabric between each successive pair of overlapping panels formed by the Z bends. The whole resultant assembly is compressed between end panels 83 and 84, and is secured together initially and during brewing, preferably by a pair of relatively narrow bands 85 which cross each other where they extend over the end panels, with one of the bands extending between the end panels across the sides of the packet where the folded edges occur, and the other extending between the end panels where the fold lines do not occur. These retaining bands are preferably formed of a web like the web 11–19, heat sealed around the packet 80.

Figure 45:
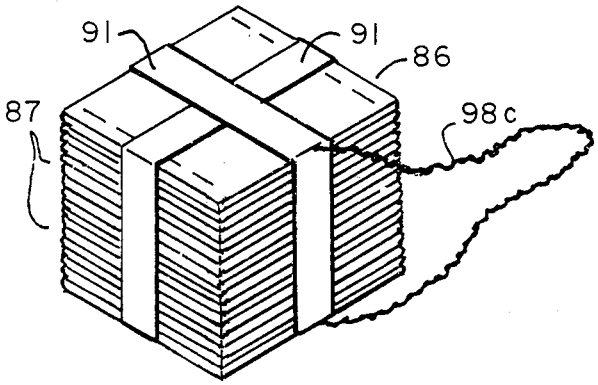
FIG. 45 shows an isometric view of a packet formed of a series of the successive units and separators shown in FIG. 44, after they have been pressed together and secured by encircling bands.
Figure 47:
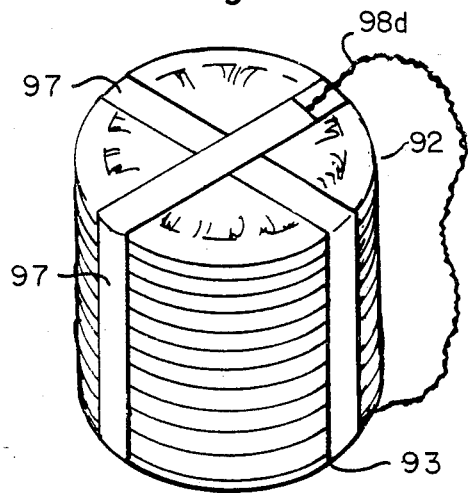
FIG. 47 shows a semi-isometric view of a packet formed of a series of the successive units and separators shown in FIG. 46, after they have been pressed together and secured encircling bands.

Non-folded forms of packets of the invention can be made by shortening the envelopes to a substantially non-elongated form. In that case, a series of separate envelopes can be stacked to form a packet, such as the packet 86 of rectangular envelopes 87 shown in FIG. 45, and the packet 92 of disk-like circular envelopes 93 shown in FIG. 47.

The substantially square envelopes 87 are preferably made by placing a substantially square layer of coffee 12 on the heat sealing side of a rectangular web 88 like the web 11–19. The longer ends of web 88 beyond coffee 12 ar folded over the coffee and heat sealed along the overlapping margins 89a (in the manner shown in FIGS. 32 and 33) and are also heat sealed where the other two sides of web 88 overlap in the form of fins 89b extending beyond the coffee layer. This forms an envelope 87 enclosing the coffee layer. Enough of these envelopes are produced to enable them to be stacked preferably with a pair of separator fabrics 90 between adjacent envelopes. The resultant generally cubical assembly is compressed between the end envelopes and secured by bands 91 (like the bands 85 around Z-form packet 80) to form the packet shown in FIG. 45. The folded edges are preferably arranged on opposite sides of the packet, so that the non-folded edges can be at the top and bottom of the packet during vertical agitation in the course of brewing.

Figure 46:
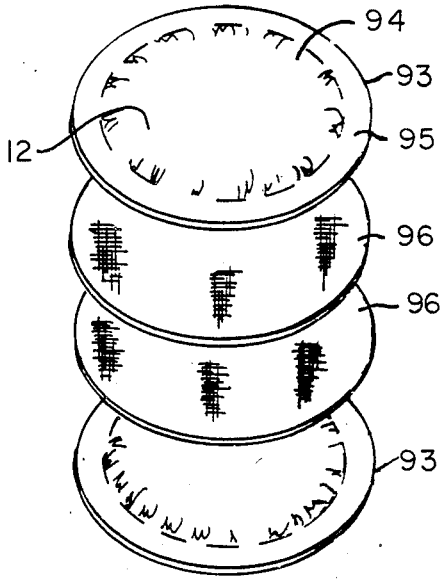

The cubical form of packet 86 can be changed to a cylindrical form of packet 92 (FIG. 47) of envelopes 93 (FIG. 46) in which a circular layer of coffee is enclosed between two circular webs 94 like web 11–19, heat sealed together along a fin 95 extending around and sealing in the coffee. A series of these disk-like envelopes are then stacked with a pair of separator fabrics 96 between adjacent envelopes 93 (FIG. 46) until the height of the resultant assembly when compressed is about equal to its diameter. The whole assembly is then secured together initially and during brewing by any convenient means, such as a pair of encircling bands 97 corresponding to the bands 85 and 91 described above in connection with packets 80 and 86.

The above-mentioned packets are preferably provided with string handles extending over one of the level faces of the packet in the case of handle 98*a* on the C-form multifold packet, over one of the faces where none of the Z-folds occur in the case of handle 98*b* for the Z-form folded packet 80, over one of the faces where the fins 89 occur in the case of the handle 98*c* for the stacked cubical packet 86, and over the cylindrical face where the stacked edges of the separate envelopes are exposed in the case of the handle 98*d* for the cylindrical packet 92.

The spiral winding of an elongated assembly to form the packet is considered best for purposes of holding the layer of coffee securely in place during brewing, while permitting enough passage of brewing water through the packet to complete brewing in a short time, and yet interposing a filter to minimize escape of particulates from the coffee into the brew. This is true whether or not the heat sealing fabric and/or the separator fabrics are used. The C-form and Z-form of multifold packet are almost as good for the purpose, and the stacked cubical and cylindrical forms are almost as good as the folded forms.

Brewing tests were made using a spiral sample, a C-form folded sample, a Z-form folded sample, and a substantially cubical stacked sample, each in the above-described preferred forms of such packets made of web like the web 11–19 and double separators of fabric like the fabrics 50*a* and *-b*. The spiral sample was made from an envelope like that used to make the C-fold and Z-fold samples. Twelve grams of "Maxwell House" roast drip grind coffee beans were closely confined in a center-seamed heat sealed envelope measuring about 22 inches long by 1½ inches wide, for purposes of making the spiral and folded samples. In final form the C-form packet was about 1½ inches high by 1½ inches in diameter. The Z-form had 14 folds and in final form was about 1½ inches square at its opposite end panels and measured about 1⅜ inches between the end panels. The stacked cubical packet was made up of 16 sealed envelopes each about 1½ inches by 1⅝ inches, and had an average thickness between its end panels of about 1⅜ inch.

The test packets just described were each brewed for two minutes in a clear glass jar containing 8 ounces of water initially at the boiling point, with agitation repeated once every second during the two minutes. The brew from each sample was observed at the end of the two minute period, and next was filtered through a relatively heavy filter paper (No. 6 "Melitta" coffee filter) and both the filtered brew and the residue trapped on the filter were observed. The results of the tests were as follows: The spiral sample produced the clearest and darkest brew before and after filtering, and had the least trapped sediment on the filter. The test results for the C-form multi-fold sample were substantially as good as for the spiral sample in all of these respects to the extent of being almost indistinguishable in results except for the brew being slightly less dark after filtering, having slightly more sedimentary particles visible before filtering and having slightly more residue left on the filter. The test results for the Z-form multi-fold sample compared with those for the C-form sample follow the same description as that for the comparison C-form sample with spiral sample. The same comparative pattern repeated when comparing results of tests of the stacked sample with the results of the Z-form sample. However, when the test results for the spiral sample and the stacked sample were compared, the differences were very minor compared to tests of what happens when the coffee is not kept confined during brewing in accordance with the invention.

The benefits of confining layered coffee between porous walls and securing it to remain so confined during brewing has been further demonstrated by evenly layering the same amount and kind of coffee used in the last-mentioned tests, within the same kind of web to form a square envelope 6½ by 6½ inches. The coffee was distributed in 16 different areas sealed between each other and around the periphery of the envelope. The same kind of separator sheet used in the last-mentiond tests was placed on opposite sides of the envelope and the whole assembly was crumpled into a closely packed ball about 2½ inches in diameter, and then was secured by a pair of encircling bands of the web material heat bonded around the outside. When such ball was given the same brewing test, it followed the above-mentioned pattern of test results, being the worst in the series but still distinctly better than comparative test results with unconfined coffee, whether in a simple bag or in the unsecured form of packet considered next.

Figure 2:
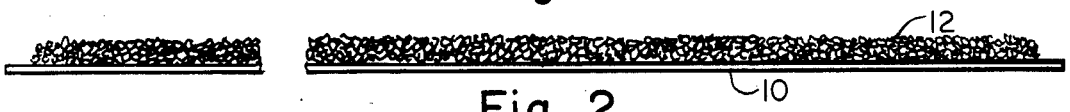
FIG. 2 shows a side view of the sheet shown in FIG. 1, after a layer of ground coffee has been evenly applied over it.
Figure 3:
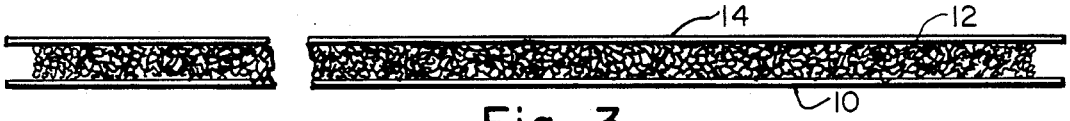
FIG. 3 shows the sheet and coffee as shown in FIG. 2, with a second sheet of porous material added above the coffee.
Figure 4:
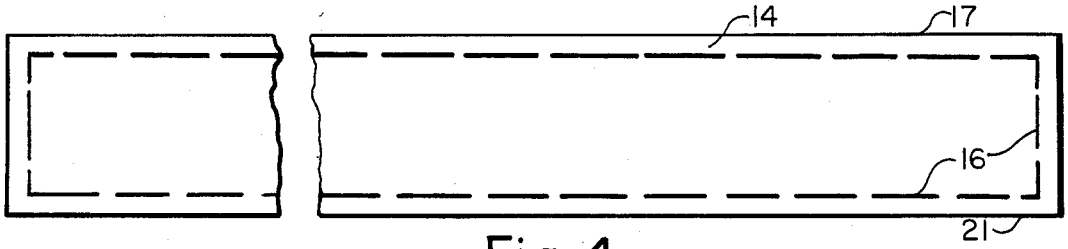
FIG. 4 shows a top view of the elements shown in FIG. 3, after addition of means joining the sheets together.

Rambold U.S. Pat. No. 3,542,561 discloses in FIGS. 1–3 a form of coffee packet which is not held together during brewing. The significance of this omission was demonstrated in the following report of tests of samples made in accordance with the Rambold disclosure and spiral samples made in accordance with the present invention:

(1) The said Rambold samples were each made by providing a sheet of filter paper and on it leveling out 12 grams of Maxwell House roasted drip ground coffee beans over an area measuring 1½×8 inches. The paper was then folded over both sides of the length of the coffee layer and seamed together over the middle of the length of the layer, substantially as shown in FIG. 2 of Rambold's U.S. Pat. No. 2,593,608. The seam was made by lapping the paper with a thermoplastic material therebetween, and heat sealing the lap together, instead of folding the seam as shown in FIG. 3 of the last mentioned patent. The ends of the resultant bag were similarly heat sealed just beyond the ends of the coffee layer. The excess paper beyond the center seam was trimmed away.

(2) The paper beyond each of the end seams was trimmed further from the seam than in the case of the center seam, to leave enough excess paper for the purposes described in the next paragraph below.

(3) In the case of each of the above mentioned samples, the opposite ends of the elongated bag were stapled together and attached to a loop of string suitable for suspending the bag from a finger, with the stapled end up. The bag was bent up in two places and bent down in one place to form a semi-W shape substantially as shown in FIGS. 1 and 2 of Rambold.

(4) The paper used in a first set of these samples was relatively thin and porous paper cut from "Melitta" wrap around coffee filters sold by Melitta, Inc., 1401 Berlin Road, Cherry Hill, N.J. 08003.

(5) The paper used to make a second set of these samples was a relatively thick paper which has more restrictive passages therethrough and which was cut from No. 6 "Melitta" coffee filters from the same company.

(6) Testing of each of these sampes was done in Richmond, Va. in a mug freshly filled with 8 oz. of water at just under boiling point. The sample was dropped into the water, where it would almost sink, and a finger holding the attached string loop would jiggle the sample to lift it upwardly every few seconds until the sample was removed 2½ minutes after its initial immersion.

(7) The samples made from the thin paper of paragraph 4 produced a fairly dark brew, but a large quantity of sediment passed through the paper into the brew. This was evidenced by the residue retained on a "Melitta" No. 6 filter of the kind referred to in paragraph 5, after its use to filter the brew made in accordance with this paragraph 7.

(8) The brew from the samples made with thick paper of the kind described in paragraph 5 had substantially less sediment but at the end of the 2½ minute brewing period was less dark than either the original or filtered brew described in paragraph 7. Increasing the brewing time would progressively increase the strength until, after the total of about 3½ minutes, it about equalled the strength of what came through when the brew made from the first set of samples (thin paper, not spiralled) in accordance with paragraph 6 was filtered as described in paragraph 7, although it was less clear.

(9) When the thin paper samples (first set, paragraph 4) were tested, the bag would unfold from its semi-W shape until it hung down to the bottom of the mug, and would be lifted out of the mug in a sagging loop.

(10) When the thick paper samples (second set, paragraph 5) were tested, the bag would widen its central bend, so that the middle portion would sag down from a tight inverted V shape to a somewhat flattened inverted V shape, and the angles of the other two bends would partially open up in response.

(11) Additional sets of samples were made in accordance with paragraphs 1, 2, 4 and 5 above, but omitting the steps of paragraph 3 taught by Rambold. Instead, in each case the bag was wound in a spiral around one end of the bag, the other end of the bag was fixed to the outside of the spiral, and a lift string was attached, all in the manner shown in FIGS. 5 and 6 of the present application, except that only about 5 coils were formed due to the substantial thickness of the bags. A third set of samples was thus formed made with the relatively thin paper described in paragraph 4 above, and a fourth set of samples were so formed using the thick paper described in paragraph 5 above.

(12) The third set of samples (with thin paper) were tested as described in paragraph 6 above. The resultant brew was not quite as dark as the brew from the first set of thin paper samples (paragraphs 1 and 4) before or after the filtration of the latter samples as described in the last sentence in paragraph 7 above. However, the amount of sediment was very much less. This was measured by filtering the brew from one of the third set of samples through the same kind of filter paper described in paragraph 7. It was obvious that there was much more trapped sediment on filter of paragraph 7 than on the filter of this paragraph 12, although the same paper was used to construct the samples used to make the brew which was filtered for these comparisons.

(13) The fourth set of samples (with thick paper, spiralled) were also tested as described in paragraph 6 above. The resultant brew was clearer (having less sediment) than the brews from the other sets of samples (first, second and third). The resultant brew took as long (3½ minutes) to reach a good strength as in the case of the thick paper samples (second set) reported in paragraph 8.

(14) A fifth set of samples (with thin paper, spiralled) were made in the same way as the third set of samples described in paragraph 11 above, except that the bag length was increased, the coffee layer was thinned evenly to extend 25 inches instead of 8, and more coils were formed. Calculation shows that the 8 inch length provides a weight to area ratio at the low end of the range of 15 to 50 square cm per gram specified in the Summary of Invention, and the 25 inch length puts the ratio in the preferred range of 30 to 45 square cm per gram specified in the Summary of Invention. The fifth set of samples were tested as described in paragraph 6, except that the brewing time was 2 minutes in some tests and 2½ minutes in others. In both cases the amount of sediment filtered out from the brew was as little as in the case of the tests reported in paragraph 12 of the third set of samples (thin paper, coffee layer 8 inches long, spiralled, 2½ minute brewing time) and after filtering, the 2 minute brew was darker, and the 2½ minute brew still darker, than the filtered brew of the third set of samples reported in paragraph 12.

While present preferred embodiments and practices of the invention have been illustrated and described, it will be understood that the invention may be otherwise variously embodied and practiced within the scope of the following claims.

I claim:

1. A packet for brewing a single serving amount of coffee when the packet is immersed in hot water, comprising:

(a) coffee in the form of roast ground coffee beans, substantially all of the coffee in the packet being distributed in thinly layered form, and substantially all of said layered form being distributed in more than several side-by-side overlapping layered wall portions;

(b) wall means supporting enclosing and maintaining said layered coffee in said distributed relation, and comprising water permeable filter means in contact with the layered coffee, such that:

(i) during immersion the water permeable wall means next to the layered coffee resists passage of coffee sediment but permits water to flow through the wall means next to the side-by-side portions of layered coffee and thence to and from said portions of layered coffee;

(ii) the side-by-side portions of layered coffee are separated from each other by said wall means;

(iii) the side-by-side portions of layered coffee and the intervening portions of said wall means are arranged next to and against each other in closely assembled relation; and (iv) the proportion of weight of layered coffee to area of wall means in contact with the layered coffee is one gram of said coffee to about 15 to 50 square centimeters of said area; and (c) means securing said wall means to maintain said layered coffee and said wall means in said distribution, arrangement and relation when the coffee-containing parts of the packet are substantially entirely immersed in hot water, said securing means not being a substantial obstacle to access of water to adjacent coffee-containing parts of the packet when they are immersed.

2. A packet according to claim 1, wherein the weight of the coffee is about 6 to 12 grams, and there are about 30 to 45 square centimeters of wall means area in contact with each gram of coffee in said coffee layers.

3. A packet according to claim 1, wherein said water permeable wall means comprises filter paper having a face in contact with the coffee in said layers an adapted to prevent most undissolved solids in the coffee layers from passing through the wall means.

4. A packet according to claim 3, in which said wall means comprising spacer means extending next to the face of said fitler paper which is the reverse side of its face in contact with said coffee layers.

5. A packet according to claim 4, in which the spacer means comprises open mesh fabric of filaments, said fabric being less resistant to passage of water than said filter paper.

6. A packet according to claim 4, in which the spacer means comprises superimposed layers of open mesh fabric of knitted filaments.

7. A packet according to claim 1, in which said wall means and said coffee layers are elongated and wound spirally in side by side relation about a common axis transverse to the elongation of the wall means.

8. A packet according to claim 1, in which said overlapping layers of coffee are portions of an elongated layer of coffee which is folded with portions of the wall means in contact therewith about a plurality of parallel axes extending transversely of the layer elongation.

9. A packet according to claim 8, in which said elongated layer and wall means are folded in Z-form reverse bends about axes extending transversely of the layer elongation.

10. A packet according to claim 1, in which said overlapping coffee layers are separately confined by different portions of said wall means and arranged in a stack.

11. A packet according to claim 1, in which the wall means comprises filter paper in contact with said layered coffee and a reticulated thermoplastic fabric bonded to substantially the whole area of the filter paper which is in contact with the layered coffee.

12. A method of forming an immersible coffee-containing packet for brewing the coffee contents in a single serving cup from which the brew may be consumed, comprising distributing coffee in the form of roast and ground coffee beans in a substantially even layer on elongated wall means inwardly of the periphery of the wall means, securing said wall means around and in contact with said coffee layer to form an envelope supporting and confining said cofee layer, said coffee being distributed in a ratio of one gram of it in contact with about 15 to 50 square centimeters of said wall means, and spirally winding several turns of said coffee layer with said wall means, said coffee layer and said wall means extending spirally with each portion of the length of said wall means along most of its length being in substantially side-by-side contact with another portion thereof such that substantially the entire interior space of the spiral packet within the outermost portions of the wall means which confines, supports and surrounds said coffee is substantially entirely occupied by said coffee and most of said wall means, except within any parts of said entire space which do not extend between the coffee layers where they overlap each other, the total of said excepted parts of said entire space being substantially smaller than the remainder of said entire space and securing said wall means and coffee in said spiral relation sufficient to maintain said spiral relation and confinement and support of the coffee layer when the coffee-containing parts of the packet are substantially entirely immersed in hot water, said elongated wall means having water permeable portions at and adjacent to its area of contact with said coffee which are capable of permitting circulation of water therethrough to and from said coffee during immersion of the coffee-containing parts of the packet.

13. The method of claim 12, in which the amount of said coffee is about 6 to 12 grams.

14. The method of claim 13, in which the total area of the wall means in contact with the coffee is about 30 to 45 square centimeters of said area per gram of coffee.

15. The method of claim 12, wherein the wall means comprises elongated separating means, and comprising the step of spirally winding said separating means between other parts of the wall means, said separating means being receptive to circulation of water therethrough.

16. The method of claim 15, in which the separating means comprises an open mesh fabric.

17. The method of claim 15, in which the separating means comprises superimposed layers of open mesh fabric.

18. The method of claim 15, in which the separating means compriss a layer of knitted fabric having spaced and substantially parallel chains of loops and substantially straight lengths of cross-linking filament therebetween, and including the step of arranging the fabric with its chains of loops extending transversely of the direction of elongation of the wall means before the spiral winding step.

* * * * *